United States Patent [19]

Van Eck

[11] Patent Number: 4,855,639

[45] Date of Patent: Aug. 8, 1989

[54] METHOD OF MANUFACTURING AN ELECTRON GUN

[75] Inventor: Arnoldus H. M. Van Eck, Eindhoven, Netherlands

[73] Assignee: U.S. Philips Corporation, New York, N.Y.

[21] Appl. No.: 190,194

[22] Filed: May 4, 1988

[30] Foreign Application Priority Data

May 21, 1987 [NL] Netherlands ..... 8701212

[51] Int. Cl.[4] ..... H01J 29/48; H01J 9/18; H01J 29/82

[52] U.S. Cl. ..... 313/456; 313/417; 313/457; 445/34

[58] Field of Search ..... 445/34, 36; 313/417, 313/451, 457, 456; 65/59.4, 59.6, 59.7

[56] References Cited

U.S. PATENT DOCUMENTS 4,096,408 6/1978 Bozzay et al. ..... 313/417
4,341,545 7/1982 Hale ..... 445/34 X
4,468,588 8/1984 Schlack ..... 313/417
4,486,685 12/1984 Hale et al. ..... 313/417
4,716,334 12/1987 Fendley et al. ..... 313/408 X

FOREIGN PATENT DOCUMENTS 130874 10/1979 Japan ..... 313/457

*Primary Examiner*—Kenneth J. Ramsey
*Attorney, Agent, or Firm*—Robert J. Kraus

[57] ABSTRACT

The invention relates to a method of manufacturing an electron gun for use in a cathode ray tube. The electrodes of the gun have plate-shaped fastening members (19) which at the free end partly surround an aperture (45). One step of the method is the bonding to each other of the electrodes and the supports (21, 22) by softening the supports and making the fastening members penetrate the supports. The protruding part (44) of the fastening member is at an angle with the direction of penetration, such that a constrained material flow through the aperture (45) develops. Thus, the fastening members (19) cool down and are clamped along various lines (46, 47, 48), which leads to an improved microphonic behaviour.

10 Claims, 5 Drawing Sheets

METHOD OF MANUFACTURING AN ELECTRON GUN

BACKGROUND OF THE INVENTION

The invention relates to a method of manufacturing an electron gun which is centered along an axis, a support of electrically insulating material and an electrode having a plate-shaped fastening member, which at a free end partly surround an aperture, being attached to each other, the support being softened, and the fastening member being introduced, at least partly, into the softened support along a direction of penetration, after which the assembly is cooled.

A method of the type described in the opening paragraph is known from U.S. Pat. No. 4,096,408. This Application describes a method of manufacturing an electron gun, in which in one step of the method electrodes and rod-like glass bodies are attached to each other by softening the rod-like glass bodies by raising the temperature, after which the glass bodies are pressed onto the fastening members, such that the material of the glass bodies surrounds a part of these fastening members, after which the assembly is left to cool down. The electrodes of U.S. Pat. No. 4,096,408 are each provided with two pairs of relatively small fastening members. The free ends of the fastening members described in U.S. Pat. No. 4,096,408 may partly surround an aperture, as shown in FIG. 7 of this Patent.

One important aspect for the quality of an electron gun is its sensitivity to vibrations, the so-called microphonic behaviour. Vibrations may be caused by external influences, for example by sound vibrations which are transmitted to the electron gun or they may be caused by processes taking place inside the electron gun, for example, changing electric voltages between electrodes, which changing voltages lead to changing forces on the electrode components. Vibrations disturb the relative position of the electrodes, subjecting the position and the intensity of the electron beam generated by the electron gun to time-dependent changes. As a consequence displays of the electron beam on, for example, a picture screen of a cathode ray tube are subject to time-dependent changes which adversely affects picture quality. In this respect it is of particular significance that the relative positions of the electrodes are disturbed by vibrations along the axis of the electron gun.

SUMMARY OF THE INVENTION

It is an object of the invention to improve the microphonic behaviour of an electron gun.

This object is achieved by a method according to the invention, which is characterized in that the fastening member is introduced in such a way that the part of the fastening member comprising the edge of the aperture of the fastening member extends into a plane which is at an oblique angle to the direction of penetration.

An important aspect of the invention is that owing to the method of the invention the fastening members are efficaciously clamped in the supports along several lines along the edge of the aperture. Vibrations in the electrode are thereby reduced.

A preferred embodiment of the method according to the invention is characterized in that the fastening member is introduced in such a way that the part of the fastening member extends in a plane which is at an angle of at least 20° to the direction of penetration.

Experiments have shown that vibrations in the electrode are reduced most effectively through the use of angles of at least 20°.

A further preferred embodiment of the method according to the invention is characterized in that the fastening member is introduced in such a way that the direction of penetration is perpendicular to the axis of the electron gun, and that the part of the fastening member extends into a plane which is substantially parallel to the vector product of the axis of the electron gun and the direction of penetration. This is the most effective way of reducing vibrations in the electrodes along the axis of the electron gun.

A further preferred embodiment of the method according to the invention is characterized in that the electron gun is arranged so as to be oriented substantially vertically, and the fastening member is introduced in such a way that the part of the fastening member extends in a plane which extends in an obliquely upward direction.

Experiments have shown that such a method generally results in a microphonic behaviour which is better than with a method in which the part extends in an obliquely downward direction.

Yet another preferred embodiment of the method according to the invention, in which the electron gun comprises as components, a cathode, a control electrode and a first anode, is characterized in that the fastening member of at least one of the aforesaid components is secured in such a way that the part of the fastening member of the relevant component comprises the edge of the aperture of the relevant fastening member and extends into a plane which is at an oblique angle to the direction of penetration.

Minor changes, caused by vibrations, in the spacing between, in particular, the cathode, the control electrode, also called $G_1$ electrode, and the first anode, also called $G_2$ electrode, may disturb the display.

A further preferred embodiment of the method according to the invention is characterized in that a fastening member is used which is made of at least 0.5 mm thick plate steel.

Experiments have shown that with a thickness of at least 0.5 mm vibrations are further reduced. Fastening members manufactured from less thick steel rendered a microphonic behaviour which relative to the 0.5 mm thick plate steel was clearly worse.

The invention also relates to an electron gun manufactured according to the method.

The invention also relates to an electron gun manufactured by means of the inventive method, and to a cathode ray tube comprising an electron gun manufactured by means of the inventive method.

Cathode ray tubes can be used in black-and-white, colour and projection televisions, in data display equipment, in cameras and in other equipment in which a cathode ray tube is used.

It is to be noted that U.S. Pat. No. 4,486,685 describes tests in which electrodes which are provided with plate-like fastening members which do not partly surround an aperture and which are deflected through an angle of 16 degrees are connected to supports by pressing these fastening members into softened supports. The extraction forces of such connections were measured i.e. the forces necessary to extract the electrodes from the supports. The results of these tests were disappointing. U.S.

Pat. No. 4,486,685 does not describe or suggest that there is a connection between the way of connecting the electrode(s) to the supports and the microphonic behaviour of an electron gun.

BRIEF DESCRIPTION OF THE DRAWING

The invention will now be described in more detail by means of a few embodiments and with reference to the drawing, in which.

DESCRIPTION OF THE PREFERRED EMBODIMENTS

Figure 1:
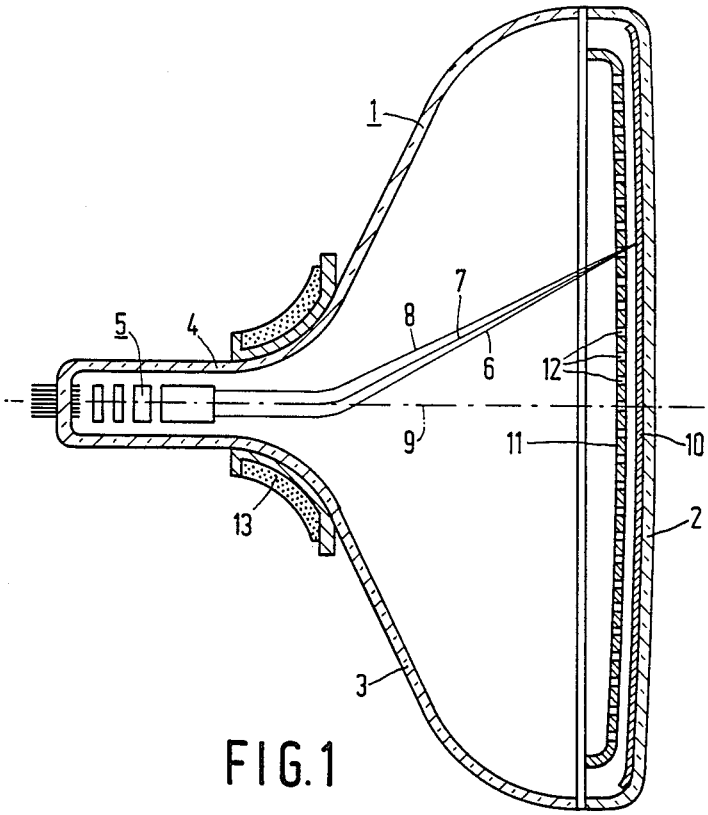
FIG. 1 is a sectional view of a cathode ray tube comprising an electron gun.

FIG. 1 is a sectional view of a cathode ray tube containing an electron gun. In this example a colour picture tube of the "in-line" type is shown. In a glass envelope 1, which consists of a display window 2, a cone 3 and a neck 4 an electron gun 5 is provided in the neck, which electron gun generates three electron beams 6, 7 and 8 whose axes extend in the plane of the drawing. The axis of the centermost electron beam 7 initially coincides with the axis 9 of the tube. The display window 2 is provided on the inside with a large number of triads of phosphor elements. These elements may take the form of, for example, lines or dots. In the present example linear elements are shown. Each triad comprises a line consisting of a phosphor emitting in green, a line consisting of a phosphor emitting in blue and a line consisting of a phosphor emitting in red. These phosphor lines are perpendicular to the plane of the drawing. A shadow mask 11 is positioned in front of the picture screen, in which mask a large number of elongated apertures 12 are provided through which pass the electron beams 6, 7 and 8, each of which is incident on phosphor lines of only one colour. The three coplanar electron beams are deflected by the system of deflection coils 13.

Figure 2:
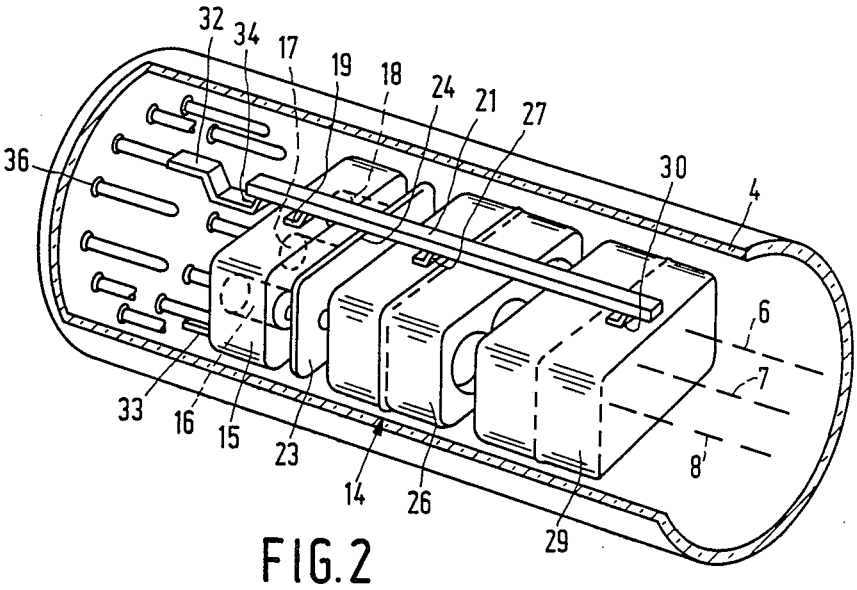
FIGS. 2 and 3 are a perspective view and a sectional view, respectively, of an electron gun manufactured by means of the method according to the invention.
Figure 3:
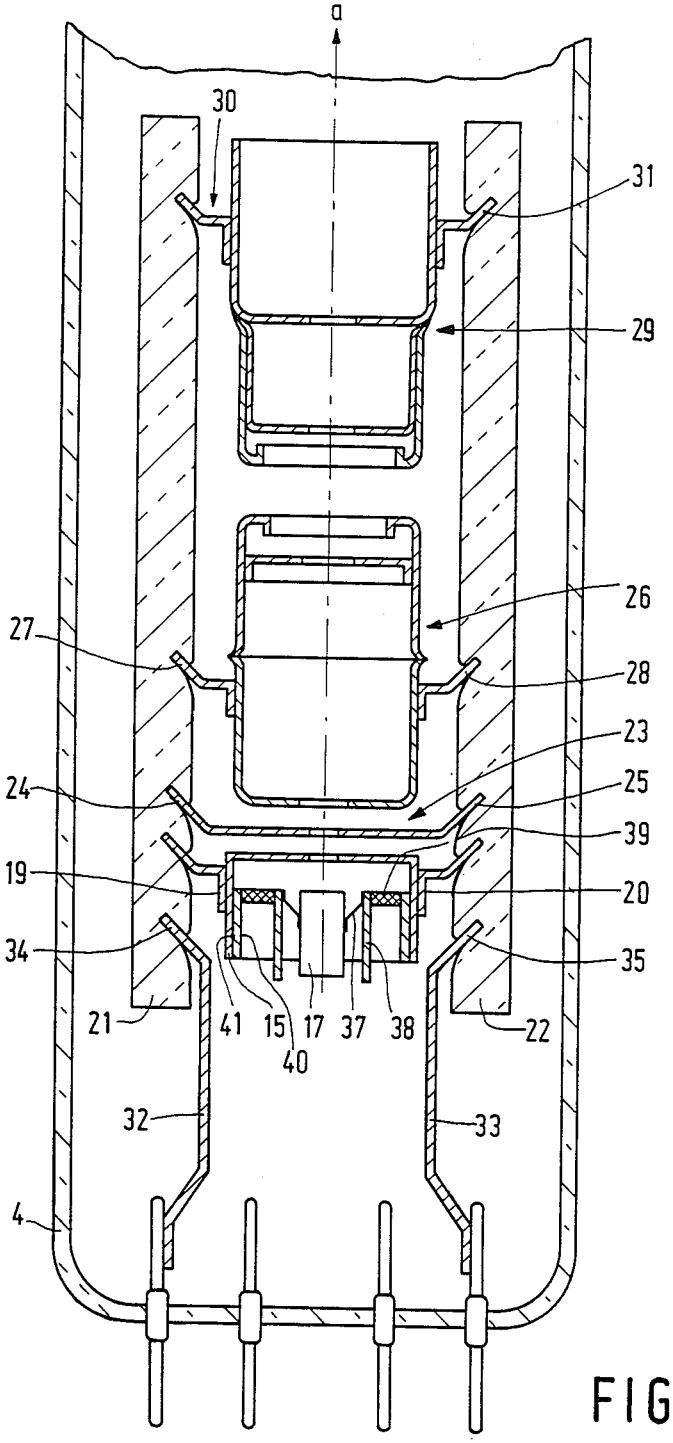

FIGS. 2 and 3 are a perspective and a sectional view, respectively, of an electron gun 14 which is manufactured by means of the method according to the invention, and which is arranged in the neck 4 of a cathode ray tube. The electron gun 14 contains a common control electrode 15 in which three cathodes 16, 17 and 18 are fixed. In this example the three cathodes are arranged in one line. The common control electrode ($G_1$) 15 is connected to supports 21 and 22 by means of fastening members 19 and 20 respectively. Consequently, the fastening members 19 and 20 and the supports 21 and 22 are interconnected. The electron gun 14 further contains a common plate-shaped anode ($G_2$) 23 which has fastening members 24 and 25 which are pressed into the supports 21 and 22. The three coplanar electron beams are focussed by means of their common electrode 26, which has fastening members 27 and 28, and their common electrode 29 which has fastening members 30 and 31. The supports are connected to feed-through pins 36 by means of supporting members 32 and 33 having fastening members 34 and 35. To illustrate the method according to the invention all surrounded parts of the fastening members are upwardly directed in FIG. 3 (in the present example, the axis A of the electron gun 14 being defined as extending in an upward direction). In this example the electron gun has two supports. The method according to the invention is in no way limited to the construction shown herein. Constructions in which the electron gun has more than two, for example three, supports, as well as constructions in which surrounded parts of various fastening members are oriented in different directions are possible. It will be clear that within the scope of the method according to the invention those skilled in the art may vary the relative orientation of the fastening members and the number of supports in many ways. FIG. 2 schematically shows the position of the cathodes 16, 17 and 18. FIG. 3 shows a possible way of securing the cathodes 16, 17 and 18 to the common control electrode ($G_1$) 15. By means of strips 37 the cathode 17 is suspended in a sleeve 38 which is connected to a holder 40 by means of an electrically insulating intermediate ring 39, which holder is welded by means of welds 41 to the common control electrode ($G_1$) 15.

Figure 4A:
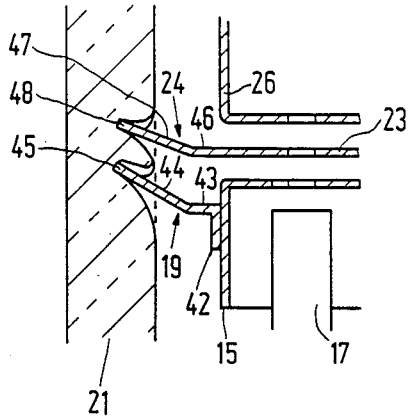
FIGS. 4*a*, 4*b* and 4*c* are sectional views of a detail of an electron gun manufactured by means of the method according to the invention.
Figure 4B:
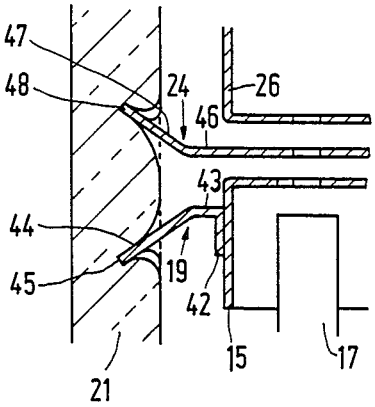
Figure 4C:
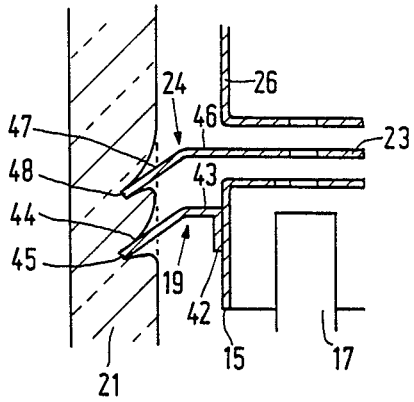

In this example each electrode has two fastening members 19 and 20, and the electron gun has two supports 21 and 22. The number of fastening members and the number of supports as well as the relative positions of the fastening members and the supports shown herein do in no way restrict the scope of the invention. For example, the two supports may be interconnected so that they form one support. Likewise, the fastening members of an electrode may be interconnected. The number of supports and the number of fastening members may amount to more than two. More than one fastening member of an electrode may be connected to a support. Different electrodes need not be attached to supports in the same way; they may even be attached to different supports. FIG. 4*a* shows a detail on an enlarged scale of the electron gun shown in FIG. 2. The common control electrode ($G_1$) 15 has a fastening member 19. In this example the fastening member 19 consists of a part 42 which is connected to the common electrode 15, a part 43 which extends in a plane perpendicularly to the axis and a part 44 which extends in a plane which is at an acute angle with the aforesaid plane. The part 44 partly surrounds an aperture 45 which is not shown in this drawing but in the FIGS. 5*a* and 5*b*. The common anode ($G_2$) 23 has a fastening member 24 which in this example consists of a part 46 extending in a plane perpendicularly to the axis of the electron gun, and a part 47 extending in a plane which is at an acute angle with the aforesaid plane. The part 47 partly surrounds an aperture 48 which is not shown in this drawing but in FIGS. 5*a* and 5*b*. FIGS. 4*b* and 4*c* only differ from FIG. 4*a* in the orientation of the parts 44 and 47.

Figure 5A:
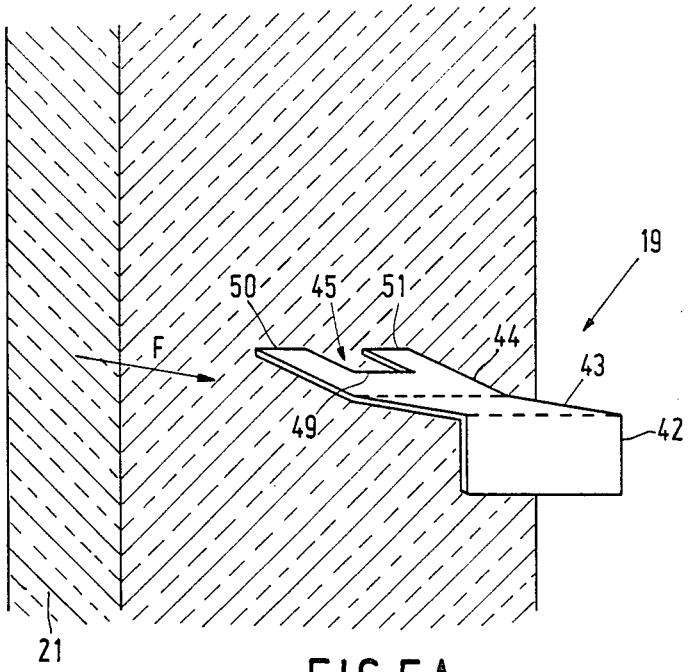
FIGS. 5*a* and 5*b* are illustrations of the method according to the invention.
Figure 5B:
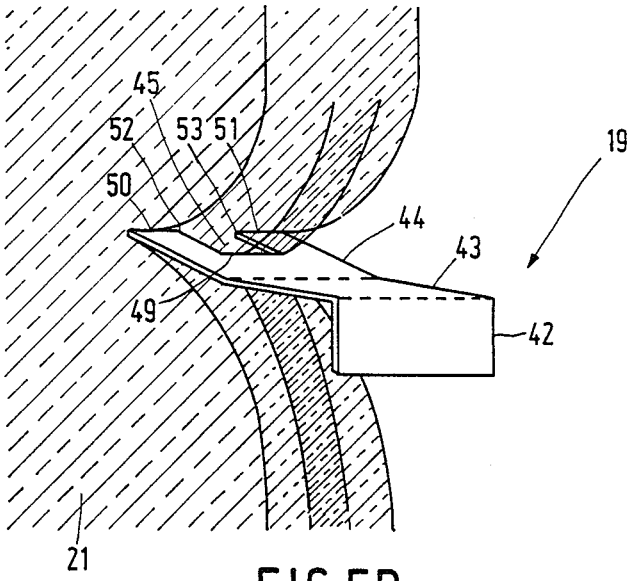
Figure 6:
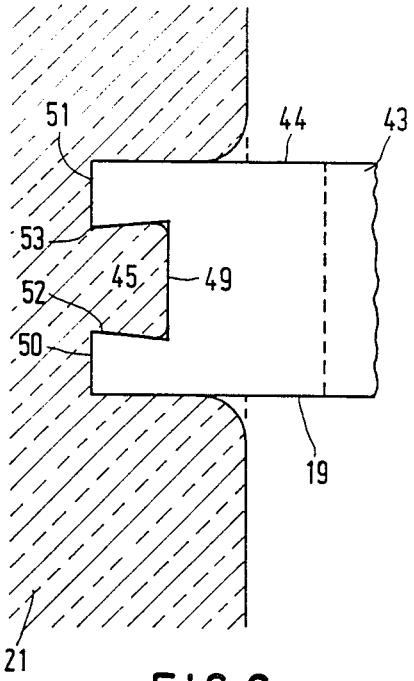
FIG. 6 is a top view of a clamped fastening member.
Figure 8:
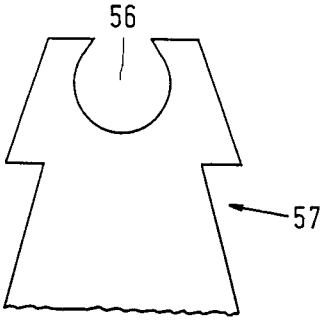
FIG. 8 shows a variant of the fastening member.
Figure 9:
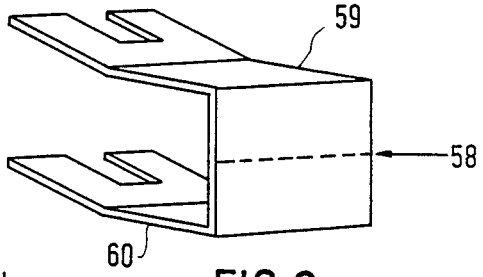
FIG. 9 shows a U-shaped fastening means formed by two fastening members.
Figure 7:
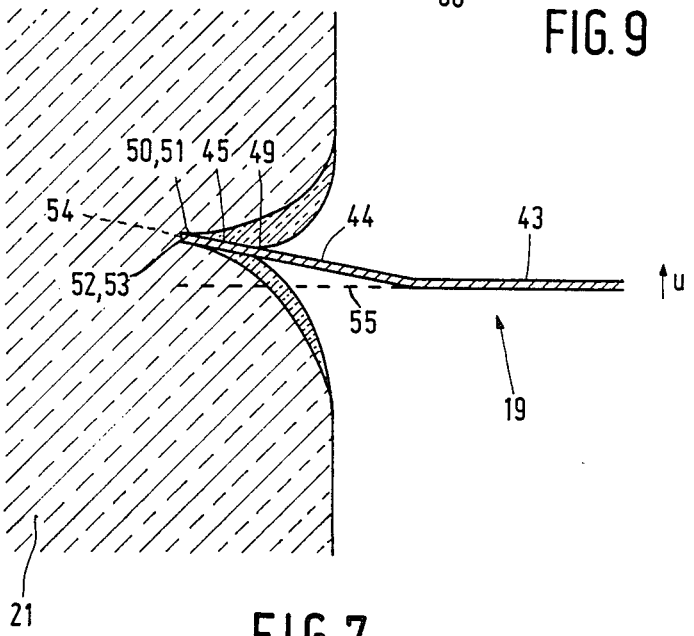
FIG. 7 is a sectional view of a clamped fastening member.

FIGS. 5*a* and 5*b* illustrate the method according to the invention. FIG. 5*a* is a perspective view of the fastening member 19. As has been stated above this fastening member consists of the parts 42, 43 and 44. The part 44 partly surrounds the aperture 45. As is shown in FIG. 3 this fastening member is connected to the common control electrode 15. However, this control electrode is not shown in the present drawing. The support 21 consists of an electrically insulating material, in the present example sintered K9 glass which is heated to a high temperature, for example to approximately 1350° C., causing the material of the support 21 to soften, after which, in this example, the fastening member 19 is pressed into the support 21. The direction of penetration is indicated in FIG. 5*a* by an arrow F, and extends, in the present example, perpendicularly to the longitudinal direction B of the support 21, which direction is parallel to the axis A of the electron gun 14, as shown in FIG. 3. The fastening member 19 is pressed into the part 44 to beyond the aperture 45, in the present example it is pressed into support 21 to beyond the line 49. The axis of the electron gun, the direction of penetration F and the normal vector of part 44 are, at least in the present example, substantially in one plane. Subsequently, the assembly is left to cool down. FIG. 5*b* is a partly perspective front view of the situation obtained after the pressing-in process. A part of the fastening member 19 is now surrounded by material of the support 21. Upon cooling the support 21 will shrink and, consequently, the fastening member 19 is clamped along the lines 49, 50 and 51. Due to the cooling of the fastening member 19 the distance between the angular points 52 and 53 of the part 44 is reduced. Thus, a clamping force is produced between these points 52 and 53. For the method according to the invention it is essential that the part 44 is not parallel to the direction of penetration F. During the penetration of the part 44 into the support 21 a constrained flow in the material of the support 21 develops, such that during cooling the fastening member becomes clamped along the line 49. The material is pressed through the aperture 45 in part 44. This causes the fastening member to become clamped along various lines, which in the present example are not in one plane and extend perpendicularly to the axis of the electron gun. In the present example along the lines 49, 50 and 51. FIG. 6 is a top view of a clamped fastening member 19. FIG. 6 clearly shows that material of the support 21 is pressed through the aperture 45 in part 44. FIG. 7 is a detailed sectional view of a clamped fastening member 19. From FIGS. 6 and 7 the improvement in the microphonic behaviour can be deducted. The fastening member 19 is clamped along the lines 50 and 51. As it is also clamped along the line 49 the fastening member cannot move relative to the plane 54. Thus, vibrations which are perpendicular to the plane 55 and which have an amplitude u are reduced. In this respect it is essential that the part 44 is not parallel to the direction of penetration F. Experiments have shown that in the case of an angle of zero degrees between the parts 43 and 44, and consequently between the direction of penetration F and the part 44, no material of the support 21 is pressed as far as the line 49, thus, the fastening member does not become clamped along this line. In this case the fastening member only becomes clamped along the lines 50 and 51. Since tilting about the lines 50 and 51 is then not precluded the amplitudes u of the vibrations perpendicularly to the plane 55 are larger in this situation. Moreover, it is essential that the part 44 partly surrounds the aperture 45, so that the fastening member becomes clamped along the line 49. Experiments have shown that vibrations from the plane 55 are even more reduced when the angle between the part 44 and the direction of penetration F is larger than 20°. Experiments have also shown that a method which is characterized in that the electron gun is oriented substantially vertically and in that the part 44 extends obliquely upwardly during the pressing-in process results in a better microphonic behaviour than a method in which the part 44 extends obliquely downwardly. This can possibly be accredited to the fact that due to the gravitational force acting on the material during the pressing-in process the material flow is directed slightly downwardly thereby crossing the line 49, which causes the fastening member to be very effectively clamped in the cooling process. Experiments have also shown that the microphonic behaviour is also influenced by the temperature to which the support is heated. Generally this behaviour improves at higher temperatures, probably due to improved flow properties of the material. FIG. 8 shows a different possible shape of the fastening member. In this example the aperture 56 is formed in a fastening member 57 by means of spark erosion. The illustrative examples of the method according to the invention shown in the FIGS. 3 to 7 lead to a reduced vibration along the axis of the electron gun. It will be clear that by means of a method according to the invention it is also possible to reduce, for example, vibrations which are perpendicular to the axis for which purpose fastening members may be used which are parallel to the axis. Further, it may be efficacious in certain cases to provide electrodes with fastening members, which comprise a number of the fastening members described hereinbefore, for example two fastening members forming a u-shaped bracket as shown in FIG. 9. In this Figure a u-shaped bracket 58 is shown which is made of the fastening members 59 and 60.

What is claimed is:

1. An electron gun comprising at least one electrode centered on a longitudinal axis, at least one support member of electrically insulating material, and at least one plate-shaped fastening member having a first part affixed to the electrode and a second part embedded in the support member, characterized in that;

a. the second part includes at a distal end thereof an edge defining an inwardly-extending opening and including a portion thereof closest to the electrode;

b. a substantial portion of the edge, including the portion closest to the electrode, lies in a plane which forms an oblique angle with a direction of insertion of said second part into the support member during manufacture; and c. the portion of the edge closest to the electrode is embedded in the material of the support member, thereby affixing said portion and minimizing the length of the fastening member between the electrode and the support member which is subject to movement parallel to the longitudinal axis during vibration.

2. An electron gun as in claim 1 where the magnitude of the oblique angle is at least 20 degrees.

3. An electron gun as in claim 1 or 2 where the direction of insertion is substantially perpendicular to the longitudinal axis.

4. A cathode ray tube comprising an envelope containing a luminescent screen and an electron gun for producing an electron beam directed at said screen, said electron gun comprising a plurality of electrodes centered on a longitudinal axis, at least one support member of electrically insulating material, and at least one plate-shaped fastening member having a first part affixed to one of the electrodes and a second port embedded in the support member, characterized in that:

a. the second part includes at a distal end thereof an edge defining an inwardly-extending opening and including a portion thereof closest to the respective electrode;

b. a substantial portion of the edge, including the portion closest to the electrode, lies in a plane which forms an oblique angle with a direction of insertion of said second part into the support member during manufacture; and c. the portion of the edge closest to the respective electrode is embedded in the material of the support member, thereby affixing said portion and minimizing the length of the fastening member between the electrode and the support member which is subject to movement parallel to the longitudinal axis during vibration.

5. A cathode ray tube as in claim 4 where the at least one fastening member is angled toward the screen.

6. A cathode ray tube as in claim 4 where the at least one fastening member is angled away from the screen.

7. A cathode ray tube as in claim 4 where first and second ones of the electrodes each have at least one of the fastening members affixed thereto, the at least one fastening member affixed to the first electrode being angled toward the screen and the at least one fastening member affixed to the second electrode being angled away from the screen.

8. A method of manufacturing an electron gun comprising at least one electrode centered on a longitudinal axis, at least one support member of electrically insulating material, and at least one plate-shaped fastening member having a first part affixed to the electrode and a second part embedded in the support member, characterized in that:

a. an inwardly-extending opening is formed in the second part at a distal end thereof, said opening being defined by an edge including a portion thereof closest to the electrode;

b. the second part is shaped such that a substantial portion of the edge, including the portion closest to the electrode, extends in a plane which forms an oblique angle with a predetermined direction of insertion of said second part into the support member; and c. while the material of the support member is in a softened state, the second part is inserted into the material in said predetermined direction until the portion of the edge closest to the electrode is embedded in said material, thereby affixing said portion and minimizing the length of the fastening member between the electrode and the support member which is subject to movement parallel to the longitudinal axis during vibration.

9. A method as in claim 8 where the electron gun is oriented with the longitudinal axis extending substantially vertically during insertion of the second part into the support member, and where the second part is angled upwardly.

10. A method as in claim 9 where the predetermined direction is horizontal.

* * * * *